US005454226A

United States Patent [19]

Darredeau et al.

[11] Patent Number: 5,454,226

[45] Date of Patent: Oct. 3, 1995

[54] PROCESS AND PLANT FOR LIQUEFYING A GAS

[75] Inventors: Bernard Darredeau, Sartrouville; Philippe Fraysse, Fontenay aux Roses; Corinne Garot, Ormesson sur Marne, all of France

[73] Assignee: L'Air Liquide, Societe Anonyme pour l'Etude et l'Exploitation des Procedes Georges Claude, Paris Cedex, France

[21] Appl. No.: 230,060

[22] Filed: Apr. 21, 1994

[30] Foreign Application Priority Data

Dec. 31, 1993 [FR] France ..... 93 15959

[51] Int. Cl.[6] ..... F25J 1/00

[52] U.S. Cl. ..... 62/9; 62/38; 62/39

[58] Field of Search ..... 62/9, 38, 39

[56] References Cited

U.S. PATENT DOCUMENTS

| | | | |
|---|---|---|---|
| 4,595,405 | 6/1986 | Agrawal et al. | 62/38 |
| 4,705,548 | 11/1987 | Agrawal et al. | 62/38 |
| 5,123,249 | 6/1992 | Buttle | 62/38 |
| 5,157,926 | 10/1992 | Guilleminot | 62/24 |
| 5,287,704 | 2/1994 | Rathbone | 62/25 |
| 5,329,776 | 7/1994 | Grenier | 62/24 |

*Primary Examiner*—Ronald C. Capossela
*Attorney, Agent, or Firm*—William S. Frommer

[57] ABSTRACT

In this process having two turbines and at least two stages for compressing the cycle gas, the two turbines are fed at the same intake pressure, the cycle gas is expanded in the warm turbine down to a first exhaust pressure, and the cycle gas is expanded in the cold turbine down to a second exhaust pressure lower than the first exhaust pressure.

17 Claims, 1 Drawing Sheet

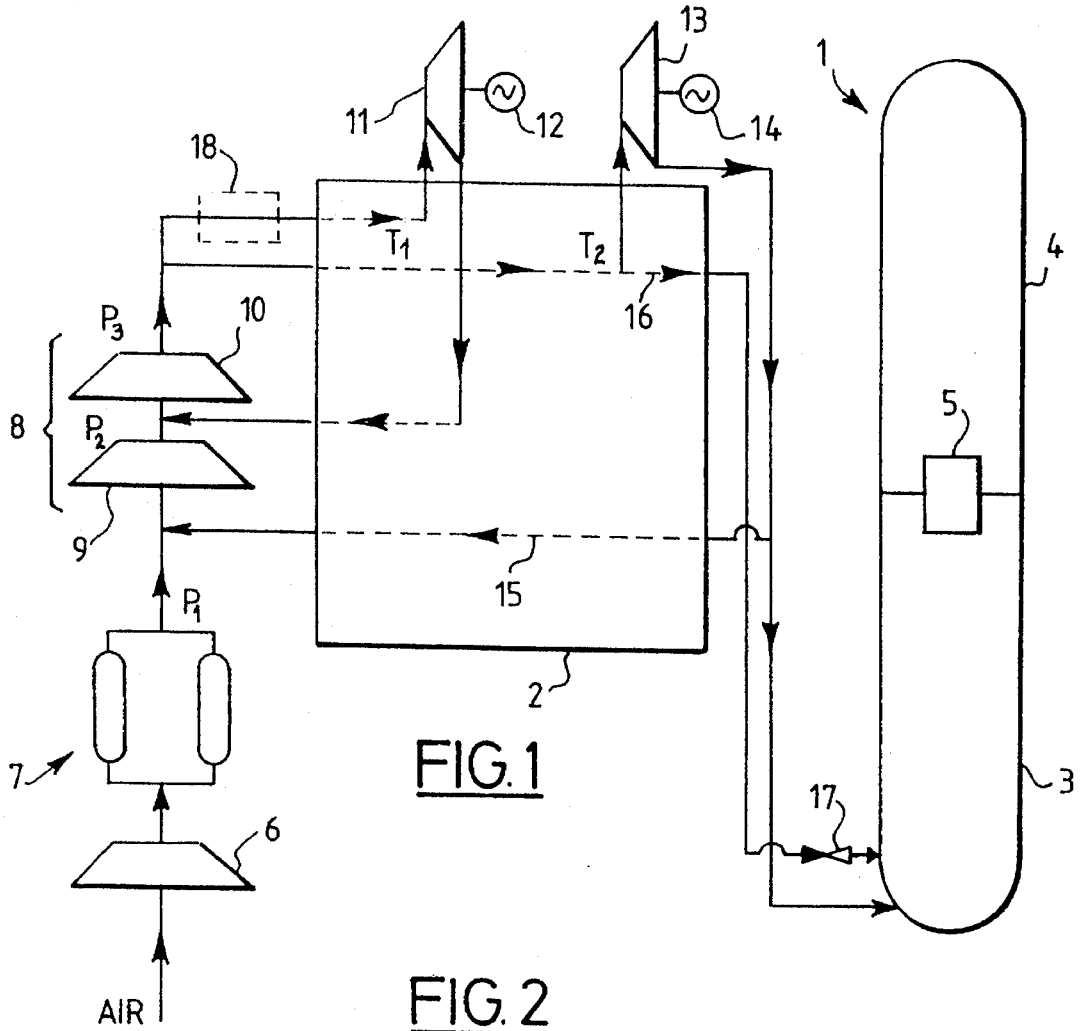
FIG. 1
FIG. 2
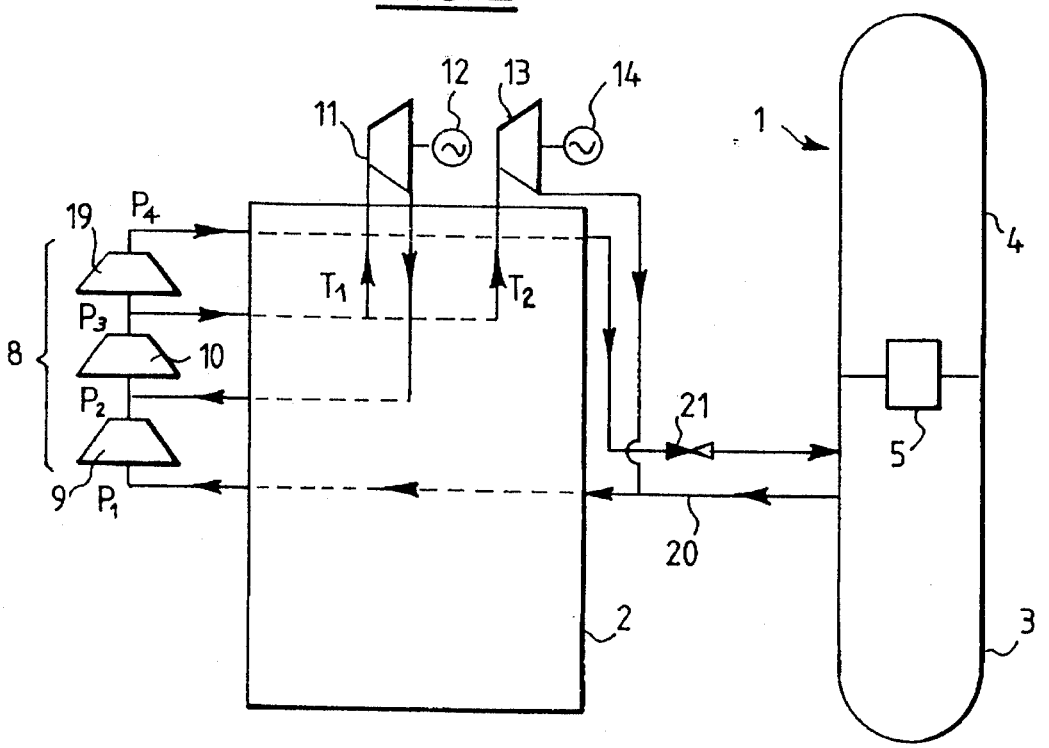

PROCESS AND PLANT FOR LIQUEFYING A GAS

The present invention relates to a process for liquefying a gas by means of a refrigerating cycle comprising a so-called "warm" expansion turbine and a so-called "cold" expansion turbine fed respectively at a first temperature and at a second temperature below the first temperature.

The object of the invention is to provide a process of this type having a particularly high yield.

For this purpose, the subject of the invention is a process of the aforementioned type, characterized in that it comprises at least two stages for compressing the cycle gas, and in that the two turbines are fed at the same intake pressure, the cycle gas is expanded in the warm turbine down to a first exhaust pressure, and the cycle gas is expanded in the cold turbine down to a second exhaust pressure lower than the first exhaust pressure.

This process may include one or more of the following characteristics:

- at least a part of the gas coming from each turbine is returned to the inlet of a compression stage;
- a part of the cycle gas constitutes the gas to be liquefied and is liquefied after having undergone the two compression stages and, possibly, an additional compression;
- the gas to be liquefied is air or a gas from air, and is sent, after liquefaction and expansion, into an air distillation apparatus;
- the exhaust pressure of the cold turbine is an operating pressure of the distillation apparatus, at least a part of the gas coming from this cold turbine being sent into the corresponding part of the distillation apparatus.

The subject of the invention is also a plant for liquefying a gas, said plant being intended for the implementation of the process defined hereinabove. This plant, of the type comprising a heat exchange line, a so-called "warm" expansion turbine, a so-called "cold" expansion turbine and cycle compression means, is characterized in that the cycle compression means comprise at least two cycle compression stages in series, the intakes of the two turbines are connected to the outlet of the same cycle compression stage, the exhaust of the warm turbine is connected to the inlet of a cycle compression stage,-and the exhaust of the cold turbine is connected to the inlet of a lower cycle compression stage.

The plant thus defined may include one or more following characteristics:

- the inlet of the first cycle compression stage is also connected to the outlet of a main air compressor of an air distillation plant, and the exhaust of the cold turbine is also connected to a part of an air distillation apparatus of this plant which operates under the exhaust pressure of this cold turbine;
- the inlet of the first cycle compression stage is also connected to a part of an air distillation apparatus which operates under its inlet pressure, and the outlet of the final cycle compression stage is connected, possibly via additional compression means, through the heat exchange line and an expansion member, to said part of the air distillation apparatus;
- the cycle compression means are constituted by a single multistage compressor, the exhaust of at least the warm turbine being connected to an interstage inlet of this compressor;
- the plant furthermore comprises a refrigerating unit for precooling at least one stream of gas to be turbined.

Exemplary embodiments of the invention will now be described with regard to the appended drawing, in which:

FIG. 1 represents diagrammatically an air liquefaction plant in accordance with the invention; and FIG. 2 represents, in a similar way, a nitrogen liquefaction plant in accordance with the invention.

Both FIGS. 1 and 2 illustrate the application of the invention to an air distillation plant comprising a double air distillation column 1 and a heat exchange line 2 of the indirect and countercurrent heat exchange type. The double column 1 itself comprises a medium-pressure column 3 mounted on a low-pressure column 4 and coupled to the latter by an evaporator-condensor 5. However, FIGS. 1 and 2 only represent the parts of the air distillation plant which are involved in the present invention, and in particular the liquefaction cycle, but it is understood that the plant also includes all the pipes and all the usual equipment necessary for the production of gas from the air by distillation. In the case of FIG. 1, the liquefied gas is air to be treated, whereas, in the case of FIG. 2, the liquefied gas is nitrogen.

In the example of FIG. 1, the plant comprises a main atmospheric-air compressor 6, an apparatus 7 for purifying air of water and of carbon dioxide by adsorption, a cycle compressor 8 having two stages 9 and 10 in series, a warm turbine 11 braked by an alternator 12, and a cold turbine 13 braked by an alternator 14.

In operation, the atmospheric air to be treated is compressed at 6 up to the medium pressure $P_1$ which is the operating pressure of the column 3 and which typically lies between 5 and 6 bar absolute, and then is purified at 7 and compressed once again at 9 to an intermediate pressure $P_2$ and then at 10 up to a high cycle pressure $P_3$, typically of the order of 30 to 100 bar absolute.

A first air fraction at this high cycle pressure $P_3$ is cooled down to an intermediate temperature $T_1$ in the warm part of the heat exchange line 2, and then output from the latter and injected into the warm turbine 11. It emerges from the latter, at the interstage pressure $P_2$ of the compressor 8, is warmed up to the ambient temperature in the warm part of the heat exchange line, and is returned to the intake of the second stage 10 of the same compressor 8.

The rest of the air at the high cycle pressure $P_3$ is cooled at 2 down to a second intermediate temperature $T_2$ below $T_1$. At this temperature, a part of the air is output from the heat exchange line and injected into the cold turbine 13 from which it emerges at the medium pressure $P_1$ and at the temperature of the cold end of the heat exchange line. This turbined air is, in part, warmed at 15 from the cold end to the warm end of the heat exchange line and returned to the inlet of the first stage 9 of the compressor 8, and, in part, sent to the vessel of the column 3. The rest of the high-pressure air cooled down to the temperature $T_2$ continues its cooling at 16 down to the cold end of the heat exchange line 2, thereby liquefying it, it is then expanded to the medium pressure $P_1$ in an expansion valve 17 and is sent into the vessel of the column 3.

As shown by the broken lines in FIG. 1, it is possible to use a refrigerating unit 18 for precooling at least one of the two high-pressure air streams coming from the compressor 8.

The electrical energy produced by the two turbines in the alternators 12 and 14 may be used for driving the cycle compressor 8.

In the embodiment of FIG. 2, the refrigerating cycle serves to liquefy nitrogen bled off at the head of the medium-pressure column 3. The cycle compressor 8 is a nitrogen compressor having three stages, the first stages 9 and 10 of which correspond to the two stages 9 and 10 of FIG. 1 and are followed by an additional stage 19 in series, delivering the nitrogen to be liquefied under a high liquefaction pressure $P_4$ above the highest pressure $P_3$ of the cycle.

As previously, the warm turbine 11 and the cold turbine 13 are both fed by the gas coming from the second stage 10, and the gas coming from the turbine 11 is returned to the inlet of this second stage 10. However, in this case, all the gas coming from the cold turbine 13 is reunited with the nitrogen bled off from the head of the column 3 via a pipe 20, warmed at 2 up to the ambient temperature and returned to the inlet of the first stage 9. In addition, the nitrogen coming from the stage 10 which has not been sent to the turbines is compressed once again at 19, and then cooled from the warm end to the cold end of the heat exchange line, thereby liquefying it. Next, this high-pressure liquid nitrogen is expanded to the medium pressure in an expansion valve 21 and reflux injected into the head of the column 3.

In each of the embodiments hereinabove, the supply of the two turbines at offset temperatures $T_1$ and $T_2$ but at the same pressure, and their exhaust at two different pressures $P_1$ and $P_2$, a lower pressure of which is for the cold turbine, lead to a high yield of the liquefaction cycle. In addition, the use of a multistage cycle compressor 8 simplifies the plant and provides a substantial advantage from the investment standpoint.

We claim:

1. A process for liquefying gas by way of a refrigerating cycle comprising the steps of:

compressing a cycle gas in first and second compression stages;

supplying the compressed cycle gas to warm and cold compression turbines, respectively, at a common intake pressure but at respective first and second intake temperatures, the first intake temperature being greater than the second intake temperature;

the warm expansion turbine expanding the cycle gas supplied thereto to a first exhaust pressure less than said common intake pressure; and the cold expansion turbine expanding said cycle gas supplied thereto to a second exhaust pressure less than said first exhaust pressure.

2. The process of claim 1 further comprising the steps of returning the cycle gas expanded by said warm expansion turbine to an inlet of one of said first and second compression stages, and returning the cycle gas expanded by said cold expansion turbine to the other of said compression stages.

3. The process of claim 2 wherein said first compression stage operates at an inlet pressure $P_1$ and an outlet pressure $P_2$, said second compression stage operates at an inlet pressure $P_2$ and an outlet pressure $P_3$; and wherein said first exhaust pressure is substantially equal to $P_2$ and said second exhaust pressure is substantially equal to $P_1$; and $P_3>P_2>P_1$.

4. The process of claim 1 further comprising the step of cooling a portion of said compressed cycle gas below said second intake temperature, thereby liquefying said portion of said compressed cycle gas.

5. The process of claim 4 further comprising the steps of expanding the liquefied compressed cycle gas, and supplying the expanded, liquefied compressed cycle gas to air distillation apparatus.

6. The process of claim 5 wherein said air distillation apparatus includes a portion operable at a pressure equal to said second exhaust pressure; and further comprising the step of supplying to said portion of said air distillation apparatus at least a portion of the cycle gas expanded to said second exhaust pressure by said cold expansion turbine.

7. The process of claim 4 wherein said cycle gas is air.

8. The process of claim 1 further comprising the steps of further compressing said cycle gas in a third compression stage having an outlet pressure $P_4$ greater than said common intake pressure; and cooling the further compressed cycle gas below said second intake temperature, thereby liquefying said further compressed cycle gas.

9. The process of claim 8 further comprising the steps of expanding the liquefied compressed cycle gas, and supplying the expanded liquefied compressed cycle gas to air distillation apparatus.

10. The process of claim 9 wherein said air distillation apparatus includes a portion operable at a pressure equal to said second exhaust pressure; and further comprising the step of supplying to said portion of said air distillation apparatus at least a portion of the cycle gas expanded to said second exhaust pressure by said cold expansion turbine.

11. The process of claim 9 wherein said cycle gas is air.

12. A plant for liquefying a gas, comprising:

a first cycle compression stage for compressing said gas from an input pressure to a first pressure and a second series-connected cycle compression stage for compressing said gas from said first pressure to a second pressure;

warm and cold expansion turbines having respective intakes connected in common to an outlet of a predetermined stage of the series-connected cycle compression stages;

the warm expansion turbine having an exhaust coupled to an inlet of said second cycle compression stage; and the cold expansion turbine having an exhaust coupled to an inlet of said first cycle compression stage.

13. The plant of claim 12 wherein said plant is an air distillation plant having a main air compressor and an air distillation column, the air distillation column having a portion operable at the exhaust pressure of said cold expansion turbine; and wherein said inlet of said first cycle compression stage is further coupled to an outlet of said main air compressor, and the exhaust of said cold expansion turbine is further coupled to said portion of said air distillation column.

14. The plant of claim 12 wherein said plant is an air distillation plant having an air distillation column which includes a portion operable at said input pressure and said inlet of said first cycle compression stage being further coupled to said portion of said air distillation column; and further comprising heat exchange means and expansion means connected in series between an outlet of the series-connected cycle compression stages and said portion of said air distillation column to liquefy compressed air and supply expanded, liquefied compressed air to said portion of said air distillation column.

15. The plant of claim 14 further comprising a third cycle compression stage for coupling the outlet of said series-connected cycle compression stages to said heat exchange means.

16. The plant of claim 12 further comprising a refrigerating unit coupled to the intake of only one of said turbines for precooling the gas supplied to said one turbine.

17. The plant of claim 16 wherein said one turbine is the warm expansion turbine.

* * * * *